US010011896B2

(12) United States Patent
Luckeneder et al.

(10) Patent No.: US 10,011,896 B2
(45) Date of Patent: Jul. 3, 2018

(54) METHOD FOR SURFACE-TREATING A METALLIC SUBSTRATE

(71) Applicant: VOESTALPINE STAHL GMBH, Linz (AT)

(72) Inventors: Gerald Luckeneder, Pinsdorf (AT); Karl-Heinz Stellnberger, Linz (AT)

(73) Assignee: voestalpine Stahl GmbH, Linz (AT)

( * ) Notice: Subject to any disclaimer, the term of this patent is extended or adjusted under 35 U.S.C. 154(b) by 135 days.

(21) Appl. No.: 14/787,942

(22) PCT Filed: Apr. 29, 2014

(86) PCT No.: PCT/AT2014/050110

§ 371 (c)(1),
(2) Date: Oct. 29, 2015

(87) PCT Pub. No.: WO2014/176621

PCT Pub. Date: Nov. 6, 2014

(65) Prior Publication Data

US 2016/0083828 A1 Mar. 24, 2016

(30) Foreign Application Priority Data

Apr. 29, 2013 (AT) ..... A 50294/2013

(51) Int. Cl.

| | |
|---|---|
| ***C23C 2/26*** | (2006.01) |
| ***C23C 22/05*** | (2006.01) |
| ***C23C 22/00*** | (2006.01) |
| ***C23C 22/06*** | (2006.01) |
| ***C25D 11/34*** | (2006.01) |
| ***C23C 22/53*** | (2006.01) |
| ***C23C 2/06*** | (2006.01) |

(52) U.S. Cl.

CPC ..... *C23C 2/26* (2013.01); *C23C 2/06* (2013.01); *C23C 22/00* (2013.01); *C23C 22/05* (2013.01); *C23C 22/06* (2013.01); *C23C 22/53* (2013.01); *C25D 11/34* (2013.01)

(58) Field of Classification Search

None

See application file for complete search history.

(56) References Cited

FOREIGN PATENT DOCUMENTS

| | | | |
|---|---|---|---|
| JP | 01127683 | A | 5/1989 |
| JP | 04165082 | A | 6/1992 |
| JP | 2011168855 | A | 9/2011 |
| WO | 2010057001 | A2 | 5/2010 |
| WO | 2012091385 | A2 | 7/2012 |

OTHER PUBLICATIONS

El-Mahdy et al, Corrosion Science, 42, pp. 183-194, 2000.*
Thebault et al, ECS Transactions, 11(22), pp. 91-105, 2008.*
Prosek et al, Corrosion Science, 50, pp. 2216-2231, 2008.*
Tian et al, Surface and Interface Analysis, 41(3), pp. 251-254, 2009.*
Schuerz et al, Corrosion Science, 51, pp. 2355-2363, 2009.*
T.A. Keppert, et al., "Influence of the pH Value on the Corrosion of Zn—Al—Mg Hot-Dip Galvanized Steel Sheets in Chloride Containing Environments," NACE International—Corrosion 2012 Conference & Expo, Mar. 11-15, 2012, Salt Lake City, UT, vol. NACE-2012-1493, Mar. 1, 2012, pp. 1-15.
J.D. Yoo, et al., "The Effect of an Artificially Synthesized Simonkolleite Layer on the Corrosion of Electrogalvanized Steel," Corrosion Science, vol. 70, Nov. 7, 2012, pp. 1-10.
J. Duchoslav, et al., "XPS Investigation on the Surface Chemistry of Corrosion Products on ZnMgAl-Coated Steel," Anal. Bioanal. Chem., vol. 405, Jul. 6, 2013, pp. 7133-7144.
P. Volovitch et al., "Understanding Corrosion Via Corrosion Product Characterization: I. Case Study of the Role of Mg Alloying in Zn—Mg Coating on Steel," Corrosion Science, vol. 51, Mar. 19, 2009, pp. 1251-1262.

* cited by examiner

*Primary Examiner* — Erma C Cameron

(57) ABSTRACT

A method for surface-treating a metallic substrate, in particular steel plate, using a protective coating on a Zn basis, according to which a chloride-containing solution is applied to the protective coating and as a result an anti-corrosion layer comprising hydrozincite and simonkolleite is formed at least in parts. To increase the corrosion resistance of the protective coating and to improve the process sequence and reproducibility of the method, the invention proposes reacting the protectively coated substrate with the solution which, using an acid, is adjusted to a pH of 4 to 6 and contains 1.8 to 18.5% by weight chloride, so as to increase the proportion of simonkolleite in relation to the proportion of hydrozincite in the anti-corrosion layer.

11 Claims, No Drawings

METHOD FOR SURFACE-TREATING A METALLIC SUBSTRATE

TECHNICAL FIELD

The invention relates to a method for surface-treating a metallic substrate, in particular steel sheet, that is equipped with a Zn-based protective coating, according to which a chloride-containing solution is applied to this protective coating and as a result, an anti-corrosion layer containing hydrozincite and simonkolleite is formed in at least some areas.

BACKGROUND OF THE INVENTION

It is known from the prior art to provide steel sheet with a Zn—Al—Mg-based protective coating in order to thus increase the corrosion resistance of the steel sheet. Surprisingly, these protectively coated steel sheets nevertheless demonstrated a corrosion resistance that fluctuated to a relatively sharp degree.

Corrosion tests according to DIN EN ISO 9227 (NSS) carried out on these protectively coated steel sheets using an aqueous 5% NaCl solution whose pH-value was regulated with NaOH demonstrated the formation of a corrosion layer with hydrotalcite, hydrozincite, and simonkolleite as components ("XPS investigation on the surface chemistry of corrosion products on ZnMgAl-coated steel," Duchoslav et al., AOFA 2012). In the corrosion layer, the concentration of hydrozincite Zn5(CO3)2(OH)6 was considerably greater than that of simonkolleite Zn5(OH)8Cl2.H2O. In addition, the corrosion layer contained hydrotalcite (Zn, Mg)6Al2 (OH)16CO3.4H2O. Simonkolleite is also known to have an elevated corrosion resistance compared to hydrozincite.

In order to increase the concentration of simonkolleite, WO2012/091385A2 suggests adjusting the weight ratios of Al and Mg in the Zn-based protective coating so that the formation of simonkolleite is facilitated when corrosion occurs. According to the proposed embodiment, in the protective coating, the ratio of Al to (Mg+Al) should lie in a range from 0.38 to 0.48. Such composition requirements, however, disadvantageously incur a comparatively large amount of effort, particularly when protective coatings are to be applied to a sheet with the aid of a hot-dip immersion method—in other words, the reproducibility of the method can only be guaranteed with difficulty. In addition, such requirements most often lead only to a compromise between improved corrosion behavior on the one hand and undesirable changes in mechanical, chemical, and/or electrical properties on the other. This can significantly limit the usability of the sheet that has been protectively coated in this way.

In addition, JP 01127683A, JP 04165082A, and JP 2011168855A disclose coatings in steel sheets that contain Zn, Mg, and/or Al.

SUMMARY OF THE INVENTION

The object of the invention, therefore, is to modify—based on the prior art explained at the beginning—a method for surface-treating a sheet with a Zn-based protective coating so that the corrosion resistance is increased, its fluctuation range is reduced, and its production is accelerated. In addition, a high degree of reproducibility of the method should be ensured and the method should be usable regardless of the composition of the Zn-based protective coating.

The invention attains the stated object in that the protectively coated substrate reacts with the solution, which is adjusted to a pH value in the range from 4 to 6 with the aid of an acid and contains 1.8 to 18.5 wt. % chloride, in order to form an elevated proportion of simonkolleite relative to the proportion of hydrozincite in the anti-corrosion layer.

If the protectively coated substrate reacts with the solution, which is adjusted to a pH value in the range from 4 to 6 with the aid of an acid and contains 1.8 to 18.5 wt. % chloride, then it is thus possible to achieve a particularly advantageous anti-corrosion layer on the protective coating. Specifically, this solution according to the invention, which is particularly also water based, can significantly promote the formation of simonkolleite on the treated and corroded surface of the protective coating. In particular, the composition of the anti-corrosion layer can be influenced in one direction such that an elevated proportion of simonkolleite always forms in it as compared to the proportion of hydrozincite. It is thus possible to reliably count on a high corrosion resistance of the protectively coated substrate. In addition, this directed treatment or initial corrosion of the protective coating can be carried out regardless of the composition of a Zn-based protective coating—it is thus possible to improve all compositions with regard to their corrosion resistance. It is thus possible to provide a universally usable and reproducible method with which it is possible to significantly reduce the influence of a hot-dip immersion process on corrosion resistance or the fluctuation range of this process with regard to the layer thickness, layer consistency, and layer composition.

The method for increasing the corrosion resistance according to the invention can particularly excel, though, if the protective coating has a Zn—Al—Mg base to which the chloride-containing solution is applied and thus an anti-corrosion layer containing hydrozincite, simonkolleite, and hydrotalcite is produced in at least some areas. It is thus possible to enable an anti-corrosion layer containing hydrozincite, simonkolleite, and hydrotalcite to form in at least some areas. Its corrosion-prone superficial intermetallic phases can be specifically supplemented with simonkolleite and can become more corrosion resistant. In addition, this causes a comparatively compact surface coating to form, which in turn can yield an increased mechanical strength of the protective coating. Subsequently, the improved bonding capacity that this achieves can be used for other layers that are applied to this protective coating, such as paints or the like. Moreover, because of the elevated chloride proportion of the solution, the production of the protective coating with the improved corrosion resistance can be accelerated and thus the method can be carried out with comparative speed.

A solution that contains 5 to 30 wt. % NaCl has turned out to be particularly advantageous. It is not only easy and inexpensive to produce, it also has a positive influence on the method. A range of 5 to 10 wt. % can be particularly suitable in order to ensure a proportion of chloride in the solution that is sufficient for the method.

If the pH value of solutions is adjusted with HCl, then it is possible not only to accelerate the activation of the corrosion reaction toward a formation of mainly simonkolleite, but also to leave the composition of the solution unchanged with regard to the number of its components. This can have a positive influence on the reproducibility of the method.

It can be particularly advantageous if the solution that is applied to the protective coating is composed of water, NaCl, and HCl. Naturally, this solution can also contain inevitable production-related impurities. This solution— which is thus easy to produce—could turn out to be advantageous in the reaction with a Zn—Al—Mg protective coating in which a proportion of simonkolleite of greater than 80% formed in the treated regions of the protective coating.

A comparatively high proportion of simonkolleite can be assured by allowing the solution to react with the coating for a maximum of 20 minutes. Even with this relatively short reaction time, the method according to the invention can ensure a particularly fast process and can subsequently also be suitable for industrial purposes.

The reaction time of the solution with the protective coating can be reduced even further if the metallic substrate is anodically charged during the reaction with the solution.

If the temperature of the solution is adjusted to a range from 30 to 60 degrees Celsius, it is possible to promote the formation of simonkolleite and thus to further accelerate the method.

The invention can particularly excel with Zn-based protective coatings that are applied to the sheet with the aid of a hot-dip immersion process—i.e. produced on the sheet. Specifically, it can be used to compensate for known parameter fluctuations of the hot-dip immersion process that can influence the corrosion resistance of the protective coating produced by means of it. The method according to the invention is thus able to ensure a maximum of corrosion protection for sheet metals with a particular degree of reproducibility.

If the reaction of the solution with the protective coating produces an anti-corrosion layer with a layer thickness in the range from 150 nm to 1.5 μm, then a sufficiently compact reaction layer with simonkolleite can be produced in order to thus reproducibly increase the corrosion resistance of the protectively coated substrate.

The chemical resistance of the Zn-based protective coating can be further increased if the reaction of the solution with the protective coating produces an anti-corrosion layer with a proportion of at least 80%, in particular at least 90%, simonkolleite.

The method according to the invention can particularly excel with a Zn—Al—Mg protective coating in which the ratio of Al/(Al+Mg) is in the range from 0.5 to 1.0, particularly if the ratio of Al/(Al+Mg) is 0.5.

DETAILED DESCRIPTION OF THE PREFERRED EMBODIMENTS

The invention will be explained by way of example below in conjunction with exemplary embodiments:

To verify that the improved corrosion resistance had been achieved, two steel sheets coated with Zn—Al—Mg were surface treated according to the invention with a solution composed of NaCl, HCl, and water, together with inevitable production-related impurities, and were compared to a Zn—Al—Mg-coated steel sheet without the surface treatment according to the invention. The ratio of Al/(Al+Mg) of the Zn—Al—Mg protective coating region is set to 0.5.

The tested protectively coated steel sheets are listed in Table 1.

TABLE 1

Overview of the tested protectively coated steel sheets 1, 2, 3

| | Composition of the solution | Simonkolleite | Hydrozincite | Hydrotalcite |
|---|---|---|---|---|
| 1 | No treatment | | Undefined/variable | |
| 2 | 5% NaCl with a pH value of 4-5 | 90% | 5% | 5% |
| 3 | 10% NaCl with a pH value of 5 | 90% | 5% | 5% |

The protectively coated sheets treated with the solution according to the invention had compact anti-corrosion layers with layer thicknesses in the range from 150 nm to 1.5 μm.

An increased corrosion resistance of the Zn—Al—Mg protective coating in protectively coated steel sheet 2 could already be achieved after 10 minutes and at a solution temperature of 30 degrees Celsius; during the reaction of the solution with the protective coating, an anodic charge (20 V, 50 $Am^{-2}$) was applied.

The same increased corrosion resistance of the Zn—Al—Mg protective coating could be achieved in protectively coated steel sheet 3 after 20 minutes and at a solution temperature of 60 degrees Celsius. In this case, it was possible to omit an anodic charging of the protective coating.

The invention claimed is:

1. A method for surface-treating a metallic substrate in order to improve corrosion resistance of the metallic substrate, the method comprising:

adjusting a pH value of a chloride-containing solution to a range from 4 to 6 using an acid, wherein the chloride-containing solution contains 1.8 to 18.5 wt % chloride;

applying the chloride-containing solution to a Zn-based protective coating on the metallic substrate and, as a result, forming an anti-corrosion layer containing hydrozincite and simonkolleite in at least some areas, the anti-corrosion layer having a layer thickness in a mute from 150 nm to 1.5 μm, wherein the protectively coated substrate reacts with the solution for a maximum of 20 minutes in order to form an elevated proportion of simonkolleite relative to the proportion of hydrozincite in the anti-corrosion layer.

2. The method according to claim 1, wherein the protective coating has a Zn—Al—Mg base to which the chloride-containing solution is applied and as a result, an anti-corrosion layer containing hydrozincite, simonkolleite, and hydrotalcite forms in at least some areas.

3. The method according to claim 2, wherein in the Zn—Al—Mg protective coating, a ratio of Al/(Al+Mg) is in a range from 0.5 to 1.0.

4. The method according to claim 1, wherein the solution contains 5 to 30 wt. % NaCl.

5. The method according to claim 1, comprising adjusting the pH value of the solution using HCl.

6. The method according to claim 5, wherein the solution that is applied to the protective coating is composed of water, NaCl, and HCl.

7. The method according to claim 1, wherein the metallic substrate is anodically charged during the reaction with the solution.

8. The method according to claim 1, comprising adjusting the temperature of the solution to a range from 30 to 60 degrees Celsius.

9. The method according to claim 1, comprising applying the Zn-based protective coating to the sheet using a hot-dip immersion process.

10. Me method according to claim 1, wherein the reaction of the solution with the protective coating forms an anti-corrosion layer with a proportion of at least 80% simonkolleite.

11. The method according to claim 1, wherein the metallic substrate is steel sheet.

* * * * *